US010425747B2

(12) United States Patent
Gran et al.

(10) Patent No.: US 10,425,747 B2
(45) Date of Patent: Sep. 24, 2019

(54) HEARING AID WITH SPATIAL SIGNAL ENHANCEMENT

(71) Applicant: GN Hearing A/S, Ballerup (DK)

(72) Inventors: Karl-Fredrik Johan Gran, Malmo (SE); Brian Dam Pedersen, Ringsted (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 13/901,922

(22) Filed: May 24, 2013

(65) Prior Publication Data

US 2014/0348331 A1 Nov. 27, 2014

(30) Foreign Application Priority Data

May 23, 2013 (DK) ..... 2013 70280
May 23, 2013 (EP) ..... 13168917

(51) Int. Cl.
*H04R 25/00* (2006.01)

(52) U.S. Cl.
CPC ..... *H04R 25/552* (2013.01); *H04R 25/00* (2013.01); *H04S 2420/01* (2013.01)

(58) Field of Classification Search
CPC .... H04R 25/00; H04R 25/552; H04S 2420/01
USPC ..... 381/312, 17, 309, 313
See application file for complete search history.

(56) References Cited

U.S. PATENT DOCUMENTS 4,817,149 A * 3/1989 Myers ..... 381/1
5,438,623 A 8/1995 Begault
6,002,775 A 12/1999 Wood et al.
7,260,231 B1 * 8/2007 Wedge ..... H04R 3/00 381/17
7,391,877 B1 6/2008 Brungart
8,208,642 B2 6/2012 Edwards
2005/0018039 A1 1/2005 Lucioni
2005/0100182 A1 5/2005 Sykes et al.
2006/0045274 A1 * 3/2006 Aarts ..... H04S 1/005 381/17
2006/0198527 A1 * 9/2006 Chun ..... H04S 3/00 381/17

(Continued)

FOREIGN PATENT DOCUMENTS

EP 1 879 426 A2 1/2008
EP 2 101 517 A1 9/2009

(Continued)

OTHER PUBLICATIONS

Extended European Search Report dated Sep. 27, 2013, for related EP Patent Application No. 13168917.6, 8 pages.

(Continued)

*Primary Examiner* — Sean H Nguyen
(74) *Attorney, Agent, or Firm* — Vista IP Law Group, LLP

(57) ABSTRACT

A new binaural hearing aid system is provided with a hearing aid in which signals that are received from external devices, such as a spouse microphone, a media player, a hearing loop system, a teleconference system, a radio, a TV, a telephone, a device with an alarm, etc., are filtered with binaural filters in such a way that a user perceives the signals to be emitted by respective sound sources positioned in different spatial positions in the sound environment of the user, whereby improved spatial separation of the different sound sources is facilitated.

39 Claims, 5 Drawing Sheets

(56) References Cited

U.S. PATENT DOCUMENTS

| | | | | |
|---|---|---|---|---|
| 2008/0008341 | A1 | 1/2008 | Edward | |
| 2009/0110220 | A1 | 4/2009 | Hain et al. | |
| 2009/0285420 | A1* | 11/2009 | Vierthaler | 381/307 |
| 2011/0295166 | A1* | 12/2011 | Dalton | 601/47 |
| 2012/0020503 | A1 | 1/2012 | Endo et al. | |
| 2012/0087506 | A1* | 4/2012 | Ozden | H04R 25/554 381/23.1 |
| 2012/0093324 | A1* | 4/2012 | Sinasi | H01Q 1/273 381/23.1 |
| 2012/0099733 | A1* | 4/2012 | Wang | H04S 1/002 381/17 |

FOREIGN PATENT DOCUMENTS

| | | | |
|---|---|---|---|
| JP | 2006-500817 | A | 1/2006 |
| JP | 2008-502200 | A | 1/2008 |
| JP | 2010-525755 | A | 7/2010 |
| JP | 2010-220191 | A | 9/2010 |
| JP | 2012-505617 | A | 3/2012 |
| WO | 2004/028204 | A2 | 4/2004 |
| WO | 2005/120133 | A1 | 12/2005 |
| WO | WO 2008-134345 | A1 | 11/2008 |
| WO | WO 2010/043223 | A1 | 4/2010 |

OTHER PUBLICATIONS

First Technical Examination and Search Report dated Nov. 25, 2013, for related Danish Patent Application No. PA 2013 70280, 6 pages.

Communication pursuant to Article 94(3) EPC dated Nov. 17, 2015, for corresponding European Patent Application No. 13168917.6, 7 pages.

Notification of Reasons for Rejection dated Jun. 7, 2016 for corresponding Japanese Patent Application No. 2014-106341, 9 pages.

Notification of First Office Action dated Jun. 27, 2017 for corresponding Chinese Patent Application No. 201410222338.1, 20 pages.

Communication pursuant to Article 94(3) EPC dated Apr. 25, 2016, for corresponding European Patent Application No. 13168917.6, 6 pages.

* cited by examiner

HEARING AID WITH SPATIAL SIGNAL ENHANCEMENT

RELATED APPLICATION DATA

This application claims priority to and the benefit of Danish Patent Application No. PA 2013 70280, filed on May 23, 2013, and European Patent Application No. 13168917.6, filed on May 23, 2013. The entire disclosures of both of the above applications are expressly incorporated by reference herein.

FIELD

A new binaural hearing aid system is provided that is configured to impart perceived spatial separation on monaural signal sources.

BACKGROUND

Hearing impaired individuals often experience at least two distinct problems:

1) A hearing loss, which is an increase in hearing threshold level, and

2) A loss of ability to understand speech in noise in comparison with normal hearing individuals. For most hearing impaired patients, the performance in speech-in-noise intelligibility tests is worse than for normal hearing people, even when the audibility of the incoming sounds is restored by amplification. Speech reception threshold (SRT) is a performance measure for the loss of ability to understand speech, and is defined as the signal-to-noise ratio required in a presented signal to achieve 50 percent correct word recognition in a hearing in noise test.

In order to compensate for hearing loss, today's digital hearing aids typically use multi-channel amplification and compression signal processing to restore audibility of sound for a hearing impaired individual. In this way, the patient's hearing ability is improved by making previously inaudible speech cues audible.

However, loss of ability to understand speech in noise, including speech in an environment with multiple speakers, remains a significant problem of most hearing aid users.

One tool available to a hearing aid user in order to increase the signal to noise ratio of speech originating from a specific speaker, is to equip the speaker in question with a microphone, often referred to as a spouse microphone, that picks up speech from the speaker in question with a high signal to noise ratio due to its proximity to the speaker. The spouse microphone converts the speech into a corresponding audio signal with a high signal to noise ratio and transmits the signal, preferably wirelessly, to the hearing aid for hearing loss compensation. In this way, a speech signal is provided to the user with a signal to noise ratio well above the SRT of the user in question.

Another way of increasing the signal to noise ratio of speech from a speaker that a hearing aid user desires to listen to, such as a speaker addressing a number of people in a public place, e.g. in a church, an auditorium, a theatre, a cinema, etc., or through a public address systems, such as in a railway station, an airport, a shopping mall, etc., is to use a telecoil to magnetically pick up audio signals generated, e.g., by telephones, FM systems (with neck loops), and induction loop systems (also called "hearing loops"). In this way, sound may be transmitted to hearing aids with a high signal to noise ratio well above the SRT of the hearing aid users.

In all of the above-mentioned examples a monaural audio signal is transmitted to the hearing aid.

However, in a situation in which a user of a conventional binaural hearing aid system desires to listen to more than one of the above-mentioned audio signal sources simultaneously, the user will find it difficult to separate one signal source from another.

U.S. Pat. No. 8,208,642 B2 discloses a method and an apparatus for a binaural hearing aid in which sound from a single monaural signal source is presented to both ears of a user wearing the binaural hearing aid in order to obtain benefits of binaural hearing when listening to the monaural signal source. The sound presented to one ear is phase shifted relative to the sound presented to the other ear, and additionally, the sound presented to one ear may be set to a different level relative to the sound presented to the other ear. In this way, lateralization and volume of the monaural signal are controlled. For example, a telephone signal may be presented to both ears in order to benefit from binaural reception of a telephone call, e.g. by relaying of the caller's voice to the ear without the telephone against it, albeit at the proper phase and level to properly lateralize the sound of the caller's voice.

Hearing aids typically reproduce sound in such a way that the user perceives sound sources to be localized inside the head. The sound is said to be internalized rather than being externalized. A common complaint for hearing aid users when referring to the "hearing speech in noise problem" is that it is very hard to follow anything that is being said even though the signal to noise ratio (SNR) should be sufficient to provide the required speech intelligibility. A significant contributor to this fact is that the hearing aid reproduces an internalized sound field. This adds to the cognitive loading of the hearing aid user and may result in listening fatigue and ultimately that the user removes the hearing aid(s).

SUMMARY

Thus, there is a need for a new binaural hearing aid system with improved localization of sound sources, i.e. there is a need for a new binaural hearing aid system capable of imparting perceived spatial information of direction and possibly distance of a respective sound source with relation to the orientation of the head of the wearer of the binaural hearing aid system.

Below, a new method is disclosed of enhancement in a hearing aid of a signal that is not received by the microphone accommodated in the hearing aid.

The new method makes use of the human auditory system's capability of distinguishing sound sources located in different spatial positions in the sound environment, and concentrating on a selected one or more of the spatially separated sound sources.

A new binaural hearing aid system using the new method is also disclosed.

According to the new method, signals from different sound sources are presented to the ears of human in such a way that the human perceives the sound sources to be positioned in different spatial positions in the sound environment of the user. In this way, the user's auditory system's binaural signal processing is utilized to improve the user's capability of separating the signals from the different sound sources and of focussing his or her listening to a desired one of the sound sources, or even to simultaneously listen to and understand more than one of the sound sources.

It has also been found that if a speech signal is presented in anti-phase, i.e. phase shifted 180° with relation to each other, in the two ears of the human, a specific direction of arrival of the speech signal is not perceived; however, many users find speech signals presented in anti-phase easy to separate from other sound sources and understand. This effect may be obtained with a phase shift ranging from 150° to 210°.

Human beings detect and localize sound sources in three-dimensional space by means of the human binaural sound localization capability.

The input to the hearing consists of two signals, namely the sound pressures at each of the eardrums, in the following termed the binaural sound signals. Thus, if sound pressures at the eardrums that would have been generated by a given spatial sound field are accurately reproduced at the eardrums, the human auditory system will not be able to distinguish the reproduced sound from the actual sound generated by the spatial sound field itself.

The transmission of a sound wave from a sound source positioned at a given direction and distance in relation to the left and right ears of the listener is described in terms of two transfer functions, one for the left ear and one for the right ear, that include any linear distortion, such as coloration, interaural time differences and interaural spectral differences. Such a set of two transfer functions, one for the left ear and one for the right ear, is called a Head-Related Transfer Function (HRTF). Each transfer function of the HRTF is defined as the ratio between a sound pressure p generated by a plane wave at a specific point in or close to the appertaining ear canal ($p_L$ in the left ear canal and $p_R$ in the right ear canal) in relation to a reference. The reference traditionally chosen is the sound pressure $p_l$ that would have been generated by a plane wave at a position right in the middle of the head with the listener absent.

The HRTF contains all information relating to the sound transmission to the ears of the listener, including diffraction around the head, reflections from shoulders, reflections in the ear canal, etc., and therefore, the HRTF varies from individual to individual.

In the following, one of the transfer functions of the HRTF will also be termed the HRTF for convenience.

The HRTF changes with direction and distance of the sound source in relation to the ears of the listener. It is possible to measure the HRTF for any direction and distance and simulate the HRTF, e.g. electronically, e.g. by filters. If such filters are inserted in the signal path between a audio signal source, such as a microphone, and headphones used by a listener, the listener will achieve the perception that the sounds generated by the headphones originate from a sound source positioned at the distance and in the direction as defined by the transfer functions of the filters simulating the HRTF in question, because of the true reproduction of the sound pressures in the ears.

Binaural processing by the brain, when interpreting the spatially encoded information, results in several positive effects, namely better signal source segregation; direction of arrival (DOA) estimation; and depth/distance perception.

It is not fully known how the human auditory system extracts information about distance and direction to a sound source, but it is known that the human auditory system uses a number of cues in this determination. Among the cues are spectral cues, reverberation cues, interaural time differences (ITD), interaural phase differences (IPD) and interaural level differences (ILD).

The most important cues in binaural processing are the interaural time differences (ITD) and the interaural level differences (ILD). The ITD results from the difference in distance from the source to the two ears. This cue is primarily useful up till approximately 1.5 kHz and above this frequency the auditory system can no longer resolve the ITD cue.

The level difference is a result of diffraction and is determined by the relative position of the ears compared to the source. This cue is dominant above 2 kHz but the auditory system is equally sensitive to changes in ILD over the entire spectrum.

It has been argued that hearing impaired subjects benefit the most from the ITD cue since the hearing loss tends to be less severe in the lower frequencies.

In accordance with the new method, a first monaural audio signal in a binaural hearing aid system originating from a first sound source, such as a first monaural signal received from a first spouse microphone, a media player, a hearing loop system, a teleconference system, a radio, a TV, a telephone, a device with an alarm, etc., is filtered with a first binaural filter in such a way that the user perceives the received first monaural audio signal to be emitted by the first sound source positioned in a first position and/or arriving from a first direction in space.

Further, a second monaural audio signal in the binaural hearing aid system originating from a second sound source, such as a second monaural signal received from a second spouse microphone, a media player, a hearing loop system, a teleconference system, a radio, a TV, a telephone, a device with an alarm, etc., may be conventionally hearing loss compensated in the binaural hearing aid system whereby the second monaural signal is perceived to be emitted by the second sound source positioned at the centre of the head of the user of the binaural hearing aid system.

The perceived spatial separation of the first and second signal sources assists the user in understanding speech in the first and second monaural audio signals, and in focussing the user's listening to a desired one of the first and second monaural audio signals.

For example, the first binaural filter may be configured to output signals intended for the right ear and left ear of the user of the binaural hearing aid system that are phase shifted with relation to each other in order to introduce a first interaural time difference whereby the perceived position of the corresponding sound source is shifted outside the head and laterally with relation to the orientation of the head of the user of the binaural hearing aid system.

In the event that the output signals intended for the right ear and left ear are phase shifted 180° with relation to each other, sense of direction is lost; however, many users find speech signals phase shifted 180° easy to separate from other signal sources and understand.

Further separation of sound sources may be obtained by provision of a second binaural filter so that the second monaural signal, such as a second monaural signal received from a second spouse microphone, a media player, a hearing loop system, a teleconference system, a radio, a TV, a telephone, a device with an alarm, etc., is filtered with the second binaural filter in such a way that the user perceives the received second monaural audio signal to be emitted by a sound source positioned in a second position and/or arriving from a second direction in space different from the first position and first direction.

For example, the second binaural filter may be configured to output signals intended for the right ear and left ear of the user of the binaural hearing aid system that are phase shifted with relation to each other in order to introduce a second interaural time difference whereby the corresponding position of the second sound source is shifted laterally, preferably in the opposite direction of the first sound source, with relation to the orientation of the head of the user of the binaural hearing aid system.

Alternatively, or additionally, the first binaural filter may be configured to output signals intended for the right ear and left ear of the user of the binaural hearing aid system that are equal to the first audio input signal multiplied with a first right gain and a first left gain, respectively; in order to obtain a first interaural level difference whereby the perceived position of the corresponding sound source is shifted laterally with relation to the orientation of the head of the user of the binaural hearing aid system.

Alternatively, or additionally, the second binaural filter may be configured to output signals intended for the right ear and left ear of the user of the binaural hearing aid system that are equal to the second audio input signal multiplied with a second right gain and a second left gain, respectively, in order to obtain a second interaural level difference whereby the perceived position of the corresponding sound source is shifted laterally, preferably in the opposite direction of the other sound source, with relation to the orientation of the head of the user of the binaural hearing aid system.

In order for the user of the new binaural hearing aid system to perceive the first audio signal source and the second audio signal source to be located in different positions in the surroundings, the pair of first interaural time difference and first interaural level difference must be different from the pair of second interaural time difference and second interaural level difference, i.e. the first and second interaural level differences may be identical provided that the first and second interaural time differences are different and vice versa.

In accordance with the new method, a first monaural audio signal in a binaural hearing aid, such as a first monaural signal received from a first spouse microphone, a media player, a hearing loop system, a teleconference system, a radio, a TV, a telephone, a device with an alarm, etc., may be filtered with a selected first HRTF of a given first direction and first distance towards a sound source so that the user perceives the received first monaural audio signal to be emitted by a sound source positioned outside the head and in the first direction and at the first distance of the first HRTF.

A second monaural audio signal, such as a second monaural signal received from a second spouse microphone, a media player, a hearing loop system, a teleconference system, a radio, a TV, a telephone, a device with an alarm, etc., may be conventionally hearing loss compensated in the binaural hearing aid system whereby the second monaural signal is perceived to originate from the centre of the head.

The perceived spatial separation of the perceived signal sources of the first and second monaural audio signals, one of which is perceived to be located outside the head of the user and one of which is perceived to be located inside the head of the user, assists the user in understanding speech in the first and second monaural audio signals, and in focussing the user's listening to a desired one of the first and second monaural audio signals.

Further separation of sound sources may be obtained by provision of a selected second HRTF so that the second monaural signal, such as a second monaural signal received from a second spouse microphone, a media player, a hearing loop system, a teleconference system, a radio, a TV, a telephone, a device with an alarm, etc., is filtered with the selected second HRTF different from the first HRTF of a given second direction and second distance towards a sound source so that the user perceives the received second monaural audio signal to be emitted by a sound source positioned in the second direction and at the second distance corresponding to the second HRTF, i.e. the first and second monaural audio signals are perceived to be emitted by sound sources located in different positions in space.

The perceived spatial separation of the perceived signal sources of the first and second monaural audio signals, both of which are perceived to be located outside the head of the user, assists the user in understanding speech in the first and second monaural audio signals, and in focussing the user's listening to a desired one of the first and second monaural audio signals.

In accordance with the new method, the first and second monaural audio signals may be filtered with approximations to respective HRTFs. For example, HRTFs may be determined using a manikin, such as KEMAR. In this way, an approximation to the individual HRTFs is provided that can be of sufficient accuracy for the hearing aid user to maintain sense of direction when wearing the hearing aid.

Thus, a new binaural hearing aid system is provided in which signals that are not received by a microphone, such as a spouse microphone, a media player, a hearing loop system, a teleconference system, a radio, a TV, a telephone, a device with an alarm, etc., are filtered with binaural filters in such a way that a user perceives the signals to be emitted by respective sound sources positioned in different spatial positions in the sound environment of the user, whereby improved spatial separation of the different sound sources is facilitated.

Accordingly, a new binaural hearing aid system is provided, comprising a first input for provision of a first audio input signal representing sound output by a first sound source and received at the first input, a second input for provision of a second audio input signal representing sound output by a second sound source and received at the second input, a first binaural filter for filtering the first audio input signal and configured to output a first right ear signal for the right ear and a first left ear signal for the left ear that are equal to the first audio input signal multiplied with a first right gain and a different first left gain, respectively, and/or that are phase shifted with a first phase shift with relation to each other, a first ear receiver for conversion of a first ear receiver input signal into an acoustic signal for transmission towards an eardrum of the first ear of a user of the binaural hearing aid system, and a second ear receiver for conversion of a second ear receiver input signal into an acoustic signal for transmission towards an eardrum of the second ear of the user of the binaural hearing aid system, and wherein the first right ear signal is provided to one of the first ear receiver input and the second ear receiver input, and the first left ear signal is provided to the other one of the first ear receiver input and the second ear receiver input, whereby the first sound source will be perceived to be spatially separated from the second sound source.

In the binaural hearing aid system, one of the first right ear signal and the first left ear signal may be phase shifted and/or amplified or attenuated with relation to the first audio input signal, while the other one of the first right ear signal and the first left ear signal is the first audio input signal.

The new binaural hearing aid system may further comprise a second binaural filter for filtering the second audio input signal and configured to output a second right ear signal for the right ear and a second left ear signal for the left ear that are equal to the second audio input signal multiplied with a second right gain and a different second left gain, respectively, and/or that are phase shifted with a second phase shift different from the first phase shift with relation to each other, and the second right ear signal may be provided to one of the first ear receiver input and the second ear receiver input, and the second left ear signal may be provided to the other one of the first ear receiver input and the second ear receiver input, whereby the first sound source will be perceived to be spatially separated from the second sound source.

Each of the first and second phase shifts and/or each of the first and second interaural level differences may correspond to azimuth directional changes towards the respective one of the first and second sound sources, ranging from −90° to 90°.

Azimuth is the perceived angle of direction towards the sound source projected onto the horizontal plane with reference to the forward looking direction of the user. The forward looking direction is defined by a virtual line drawn through the centre of the user's head and through a centre of the nose of the user. Thus, a sound source located in the forward looking direction has an azimuth value of 0°, and a sound source located directly in the opposite direction has an azimuth value of 180°. A sound source located in the left side of a vertical plane perpendicular to the forward looking direction of the user has an azimuth value of −90°, while a sound source located in the right side of the vertical plane perpendicular to the forward looking direction of the user has an azimuth value of +90°.

Throughout the present disclosure, one signal is said to represent another signal when the one signal is a function of the other signal, for example the one signal may be formed by analogue-to-digital conversion, or digital-to-analogue conversion of the other signal; or, the one signal may be formed by conversion of an acoustic signal into an electronic signal or vice versa; or the one signal may be formed by analogue or digital filtering or mixing of the other signal; or the one signal may be formed by transformation, such as frequency transformation, etc, of the other signal; etc.

Further, signals that are processed by specific circuitry, e.g. in a signal processor, may be identified by a name that may be used to identify any analogue or digital signal forming part of the signal path of the signal in question from its input of the circuitry in question to its output of the circuitry. For example an output signal of a microphone, i.e. the microphone audio signal, may be used to identify any analogue or digital signal forming part of the signal path from the output of the microphone to its input to the receiver, including any processed microphone audio signals.

The new binaural hearing aid system may comprise multi-channel first and/or second hearing aids in which the audio input signals are divided into a plurality of frequency channels for individual processing of at least some of the audio input signals in each of the frequency channels.

The plurality of frequency channels may include warped frequency channels, for example all of the frequency channels may be warped frequency channels.

The new binaural hearing aid system may additionally provide circuitry used in accordance with other conventional methods of hearing loss compensation so that the new circuitry or other conventional circuitry can be selected for operation as appropriate in different types of sound environment. The different sound environments may include speech, babble speech, restaurant clatter, music, traffic noise, etc.

The new binaural hearing aid system may for example comprise a Digital Signal Processor (DSP), the processing of which is controlled by selectable signal processing algorithms, each of which having various parameters for adjustment of the actual signal processing performed. The gains in each of the frequency channels of a multi-channel hearing aid are examples of such parameters.

One of the selectable signal processing algorithms operates in accordance with the new method.

For example, various algorithms may be provided for conventional noise suppression, i.e. attenuation of undesired signals and amplification of desired signals.

Microphone audio signals obtained from different sound environments may possess very different characteristics, e.g. average and maximum sound pressure levels (SPLs) and/or frequency content. Therefore, each type of sound environment may be associated with a particular program wherein a particular setting of algorithm parameters of a signal processing algorithm provides processed sound of optimum signal quality in a specific sound environment. A set of such parameters may typically include parameters related to broadband gain, corner frequencies or slopes of frequency-selective filter algorithms and parameters controlling e.g. knee-points and compression ratios of Automatic Gain Control (AGC) algorithms.

Signal processing characteristics of each of the algorithms may be determined during an initial fitting session in a dispenser's office and programmed into the new binaural hearing aid system in a non-volatile memory area.

The new binaural hearing aid system may have a user interface, e.g. buttons, toggle switches, etc, of the hearing aid housings, or a remote control, so that the user of the new binaural hearing aid system can select one of the available signal processing algorithms to obtain the desired hearing loss compensation in the sound environment in question.

The new binaural hearing aid system may be capable of automatically classifying the user's sound environment into one of a number of sound environment categories, such as speech, babble speech, restaurant clatter, music, traffic noise, etc, and may automatically select the appropriate signal processing algorithm accordingly as known in the art.

A binaural hearing aid system includes: a first input for provision of a first audio input signal representing sound output by a first sound source and received at the first input; a second input for provision of a second audio input signal representing sound output by a second sound source and received at the second input; a first binaural filter for filtering the first audio input signal and configured to output a first right ear signal for a right ear of a user of the binaural hearing aid system and a first left ear signal for a left ear of the user, wherein the first right ear signal and the first left ear signal are (1) phase shifted with a first phase shift with relation to each other, (2) equal to the first audio input signal multiplied with a first right gain and a first left gain, respectively, the first left gain being different from the first right gain, or (3) equal to the first audio input signal multiplied with the first right gain and the first left gain, respectively, and phase shifted with the first phase shift with relation to each other; a first ear receiver; and a second ear receiver; wherein one of the first ear receiver and the second ear receiver is configured to provide an acoustic signal for transmission towards an eardrum of the first ear of a user of the binaural hearing aid system based on the first right ear signal, and the other one of the first ear receiver and the second receiver is configured to provide an acoustic signal for transmission towards an eardrum of the second ear of the user of the binaural hearing aid system based on the first left ear signal.

Optionally, the first ear receiver and the second ear receiver are configured to provide the acoustic signals so that the first sound source and the second sound source will be perceived by the user as being spatially separated from each other.

Optionally, the first phase shift has a value that is anywhere from 150° to 210°.

Optionally, the first phase shift corresponds to an azimuth directional change that is anywhere from −90° to 90°.

Optionally, one of the first right ear signal and the first left ear signal is phase shifted with relation to the first audio input signal, and the other one of the first right ear signal and the first left ear signal is the first audio input signal.

Optionally, the binaural hearing aid system further includes a second binaural filter for filtering the second audio input signal and configured to output a second right ear signal for the right ear and a second left ear signal for the left ear, wherein the second right ear signal and the second left ear signal are (1) phase shifted with a second phase shift different from the first phase shift with relation to each other, (2) equal to the second audio input signal multiplied with a second right gain and a second left gain, respectively, the second left gain being different from the second right gain, or (3) equal to the second audio input signal multiplied with the second right gain and the second left gain, respectively, and phase shifted with the second phase shift with relation to each other; wherein one of the first ear receiver and the second ear receiver is configured to receive the second right ear signal, and the other one of the first ear receiver and the second ear receiver is configured to receive the second left ear signal.

Optionally, the binaural hearing aid system further includes: a first hearing aid comprising the first input, the first binaural filter, and the first ear receiver; and a second hearing aid comprising the second ear receiver.

Optionally, the binaural hearing aid system further includes: a first hearing aid comprising the first input, the first binaural filter, the second input, the second binaural filter, and the first ear receiver; and a second hearing aid comprising the second ear receiver.

Optionally, the binaural hearing aid system further includes: a first hearing aid comprising the first input, the first binaural filter, and the first ear receiver; and a second hearing aid comprising the second input, the second binaural filter, and the second ear receiver.

Optionally, the first binaural filter is a HRTF filter.

Optionally, the second binaural filter is a HRTF filter.

Optionally, at least one of the first audio input signal and the second audio input signal is a monaural audio signal.

A method of binaural signal enhancement in a binaural hearing aid system, includes: binaurally filtering a first audio input signal representing sound from a first sound source into a first right ear signal for a right ear of a user of the binaural hearing aid system and a first left ear signal for a left ear of the user, wherein the first right ear signal and the first left ear signal are (1) phase shifted with a first phase shift with relation to each other, (2) are equal to the first audio input signal multiplied with a first right gain and a first left gain, respectively, the first left gain being different from the first right gain, or (3) equal to the first audio input signal multiplied with the first right gain and the first left gain, respectively, and phase shifted with the first phase shift with relation to each other; providing the first right ear signal and the first left ear signal to the right and left ears, respectively, of the user, and providing a second audio input signal representing sound output by a second source to both the right and left ears of the user.

Optionally, the acts of providing are performed so that the first sound source and the second sound source will be perceived by the user as being spatially separated from each other.

Optionally, the method further includes: binaurally filtering the second audio input signal into a second right ear signal for the right ear and a second left ear signal for the left ear, wherein the second right ear signal and the second left ear signal are (1) phase shifted with a second phase shift different from the first phase shift with relation to each other, (2) equal to the second audio input signal multiplied with a second right gain and a second left gain, respectively, the second left gain being different from the second right gain, or (3) equal to the second audio input signal multiplied with the second right gain and the second left gain, respectively, and phase shifted with the second phase shift different from the first phase shift with relation to each other; wherein the act of providing the second audio input signal to both the right and left ears comprises providing the second right ear signal and the second left ear signal to the right and left ears, respectively, of the user.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting to the scope of the claims.

DETAILED DESCRIPTION

Figure 1:
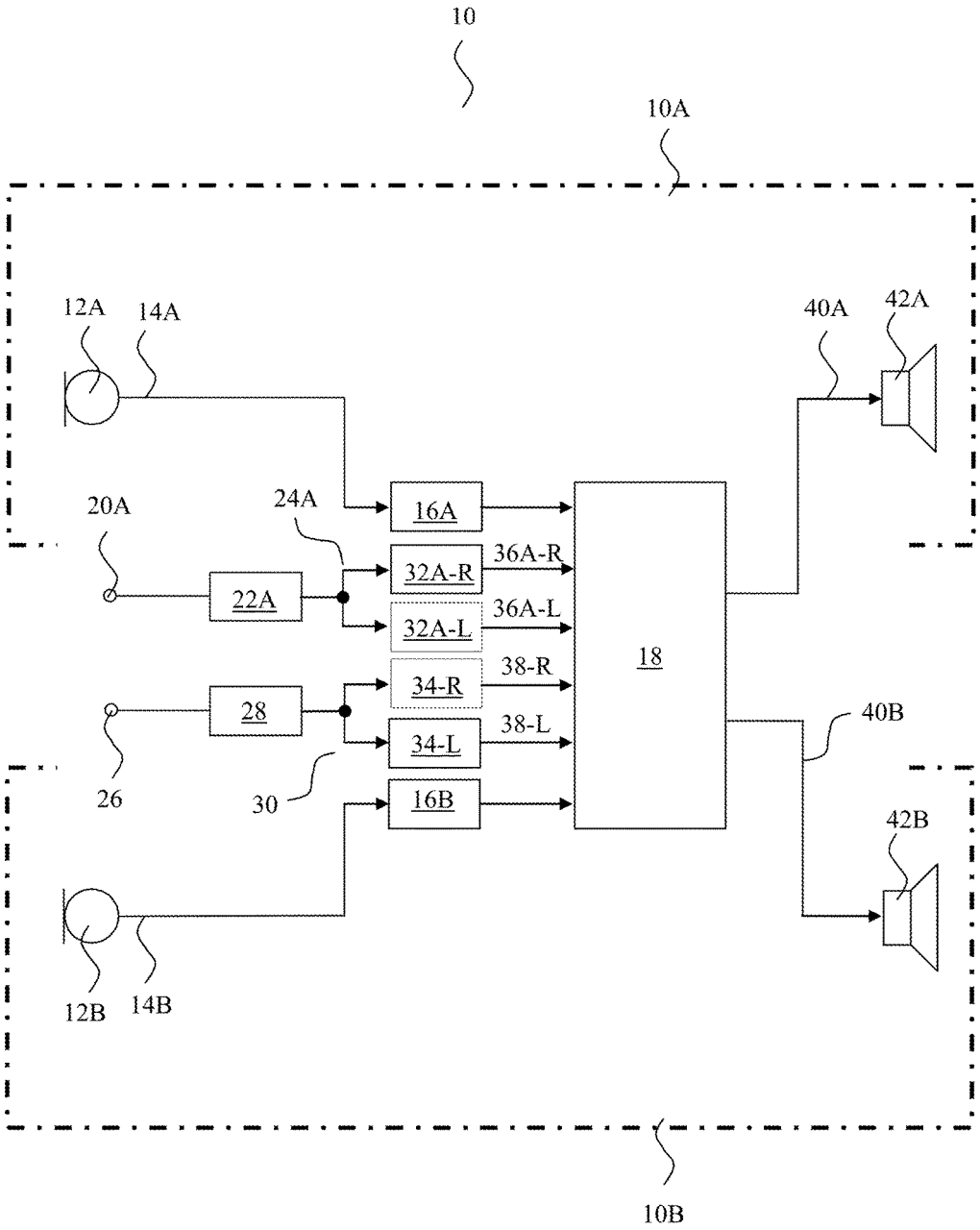
FIG. 1 schematically illustrates an exemplary new binaural hearing aid system, FIG. 2 schematically illustrates an exemplary new binaural hearing aid system, FIG. 3 schematically illustrates an exemplary new binaural hearing aid system, FIG. 4 schematically illustrates an exemplary new binaural hearing aid system, and FIG. 5 schematically illustrates an exemplary new binaural hearing aid system.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. The claimed invention may be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The new method and binaural hearing aid system will now be described more fully hereinafter with reference to the accompanying drawings, in which various examples of the new binaural hearing aid system are shown. The new method and binaural hearing aid system may, however, be embodied in different forms and should not be construed as limited to the examples set forth herein.

It should be noted that the accompanying drawings are schematic and simplified for clarity.

Like reference numerals refer to like elements throughout. Like elements will, thus, not be described in detail with respect to the description of each figure.

FIG. 1 schematically illustrates an example of the new binaural hearing aid system 10.

The new binaural hearing aid system 10 has first and second hearing aids 10A, 10B.

The first hearing aid 10A comprises a first microphone 12A for provision of first microphone audio signal 14A in response to sound received at the first microphone 12A. The microphone audio signal 14A may be pre-filtered in a first pre-filter 16A well-known in the art, and input to a signal processor 18.

The first microphone 12A may include two or more microphones with signal processing circuitry for combining the microphone signals into the microphone audio signal 14A. For example, the first hearing aid 10A may have two microphones and a beamformer for combining the microphone signals into a microphone audio signal 14A with a desired directivity pattern as is well-known in the art of hearing aids.

The first hearing aid 10A also comprises a first input 20A for provision of a first audio input signal 24A representing sound output by a first sound source (not shown) and received at the first input 20A that is not a microphone input.

The first sound source may be a spouse microphone (not shown) carried by a person the hearing aid user desires to listen to. The output signal of the spouse microphone is encoded for transmission to the first hearing aid 10A using wireless or wired data transmission. The transmitted data representing the spouse microphone audio signal are received by a receiver and decoder 22A for decoding into the first audio input signal 24A.

The second hearing aid 10B comprises a second microphone 12B for provision of second microphone audio signal 14B in response to sound received at the second microphone 12B. The microphone audio signal 14B may be pre-filtered in a second pre-filter 16B well-known in the art, and input to signal processor 18.

The second microphone 12B may include two or more microphones with signal processing circuitry for combining the microphone signals into the microphone audio signal 14B. For example, the second hearing aid 10B may have two microphones and a beamformer for combining the microphone signals into a microphone audio signal 14B with a desired directivity pattern as is well-known in the art of hearing aids.

The binaural hearing aid system 10 also comprises a second input 26 for provision of a second audio input signal 30 representing sound output by a second sound source (not shown) and received at the second input 26.

The second sound source may be a second spouse microphone (not shown) carried by a second person the hearing aid user desires to listen to. The output signal of the second spouse microphone is encoded for transmission to the binaural hearing aid system 10 using wireless or wired data transmission. The transmitted data representing the spouse microphone audio signal are received by a receiver and decoder 28 for decoding into the second audio input signal 30.

The second input 26 and receiver and decoder 28 may be accommodated in the first hearing aid 10A or in the second hearing aid 10B.

In the event that the first and second audio input signal 24A, 30 are presented to the ears of the user as monaural signals, i.e. the same signal is presented to both ears of the user, and both signals will be perceived to originate from the centre of the head of the user of the binaural hearing aid system.

Although the signals are compensated for hearing loss, as is well-known in the art of hearing aids, a user with hearing loss will have difficulties in understanding more than one monaural audio input signal at the time due to lack of perceived spatial separation of the signal sources.

Therefore at least one of the first and second audio input signals 24A, 30 is filtered in such a way that the user of the binaural hearing aid system 10 perceives the corresponding signal source to be moved away from the centre of the head of the user.

The resulting perceived spatial separation of the sound sources facilitates that the user's auditory system's binaural signal processing is utilized to improve the user's capability of separating the signals from the sound sources and of focussing his or her listening to a desired one of the sound sources, or even to simultaneously listen to and understand more than one of the sound sources.

It has also been found that if a speech signal is presented in anti-phase, i.e. phase shifted 180° with relation to each other, in the two ears of the human, a specific direction of arrival of the speech signal is not perceived; however, many users find the speech signal presented in anti-phase easy to separate from other signal sources and understand.

In the illustrated new binaural hearing aid system 10, a set of two filters 32A-R, 32A-L, 34-R, 34-L is provided with inputs connected to the respective outputs 24A, 30 of each of the respective receivers and decoders 22A, 28 and with outputs 36A-R, 36A-L, 38-R, 38-L, one of which 36A-R, 38-R provides an output signal to the right ear and the other 36A-L, 38-L provides an output signal to the left ear. The sets of two filters 32A-R, 32A-L, 34-R, 34-L have transfer functions of respective HRTFs 32A, 34 imparting selected directions of arrival to the first and second sound sources. In one example of the system of FIG. 1, the HRTF 32A imparts a perceived direction of arrival to the first sound source having a direction of arrival with −45° azimuth, while the HRTF 34 imparts a perceived direction of arrival to the second sound source having a direction of arrival with +45° azimuth.

The first hearing aid 10A and the second hearing aid 10B may be configured for hearing loss compensation of the right ear and the left ear of the user, respectively; or, vice versa. For ease of description, in the following, the first hearing aid 10A is assumed to be configured for hearing loss compensation of the right ear; however, the operating principles of the new binaural hearing aid system and method do not depend on for which of the right and left ears, the first and second hearing aids perform hearing loss compensation.

The output of the filters 32A-R, 32A-L, 34-R, 34-L, are processed in signal processor 18 for hearing loss compensation and the processor output signal 40A intended to be transmitted towards the right ear is connected to a first receiver 42A of the first hearing aid 10A for conversion into an acoustic signal for transmission towards an eardrum of the right ear of a user of the binaural hearing aid system 10, and the processor output signal 40B intended to be transmitted towards the left ear is connected to a second receiver 42B of the second hearing aid 10B for conversion into an acoustic signal for transmission towards an eardrum of the left ear of the user of the binaural hearing aid system 10.

The HRTFs 32A, 34 may be individually determined for the user of the binaural hearing aid system, whereby the user's perceived externalization of and sense of direction towards the first and second sound sources will be distinct since the HRTFs will contain all information relating to the sound transmission to the ears of the user, including diffraction around the head, reflections from shoulders, reflections in the ear canal, etc., which cause variations of HRTFs of different users.

Good sense of directions may also be obtained by approximations to individually determined HRTFs, such as HRTFs determined on a manikin, such as a KEMAR head, provided that the approximation to the individual HRTF is sufficiently accurate for the hearing aid user to maintain sense of direction towards the first and second sound sources. Likewise, approximations may be constituted by HRTFs determined as averages of individual HRTFs of humans in a selected group of humans with certain physical similarities leading to corresponding similarities of the individual HRTFs, e.g. humans of the same age or in the same age range, humans of the same race, humans with similar sizes of pinnas, etc.

Figure 2:
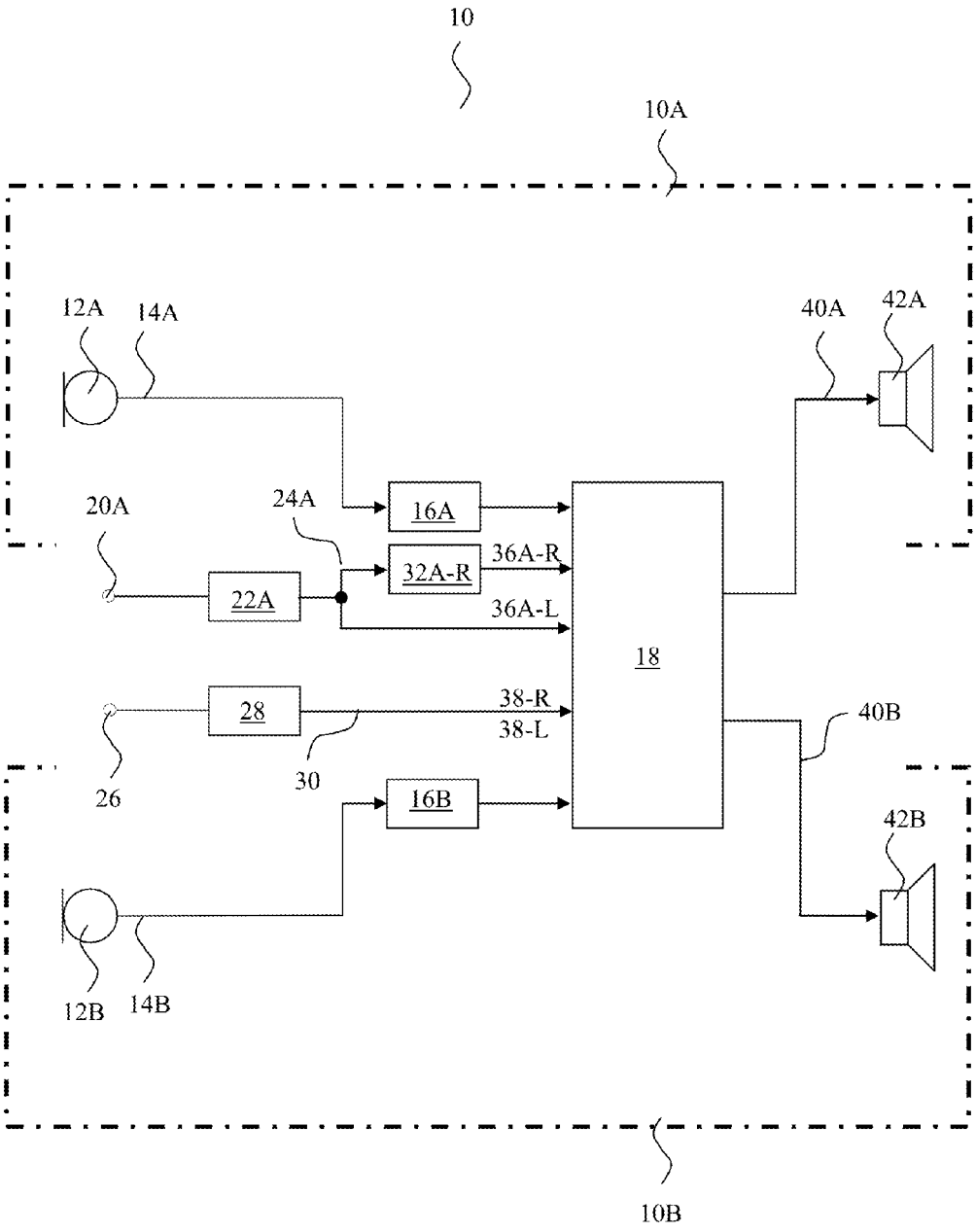

FIG. 2 shows an example of the new binaural hearing aid system 10 similar to the example shown in FIG. 1 except for the fact that sufficient perceived spatial separation between the first and second sound sources is obtained by introducing a delay equal to the ITD of a desired azimuth direction of arrival in the signal path from the first receiver and decoder 22A to one of the ears of the user. In the illustrated example, the filter 32A-R introduces a time delay between its input signal 24A and output signal 36A-R intended for the right ear of the user, while the filter 32A-L shown in FIG. 1 is constituted by a direct connection between input 24A and output 36A-L.

In this way, the perceived azimuth of the direction of arrival of the first sound source is shifted, e.g. to −45°, while the signal from the second sound source is presented monaurally to the ears of the user, i.e. the output 30 of the receiver and decoder 28 is input as a monaural signal to the signal processor 18 and output to both ears of the user. Thus, perceived spatial separation of the first and second sound sources is obtained, since the first sound source is perceived to be position in a direction determined by the delay 32A-R, e.g. 45° azimuth, while the second sound source is perceived to be positioned at the centre inside the head of the user.

Figure 3:
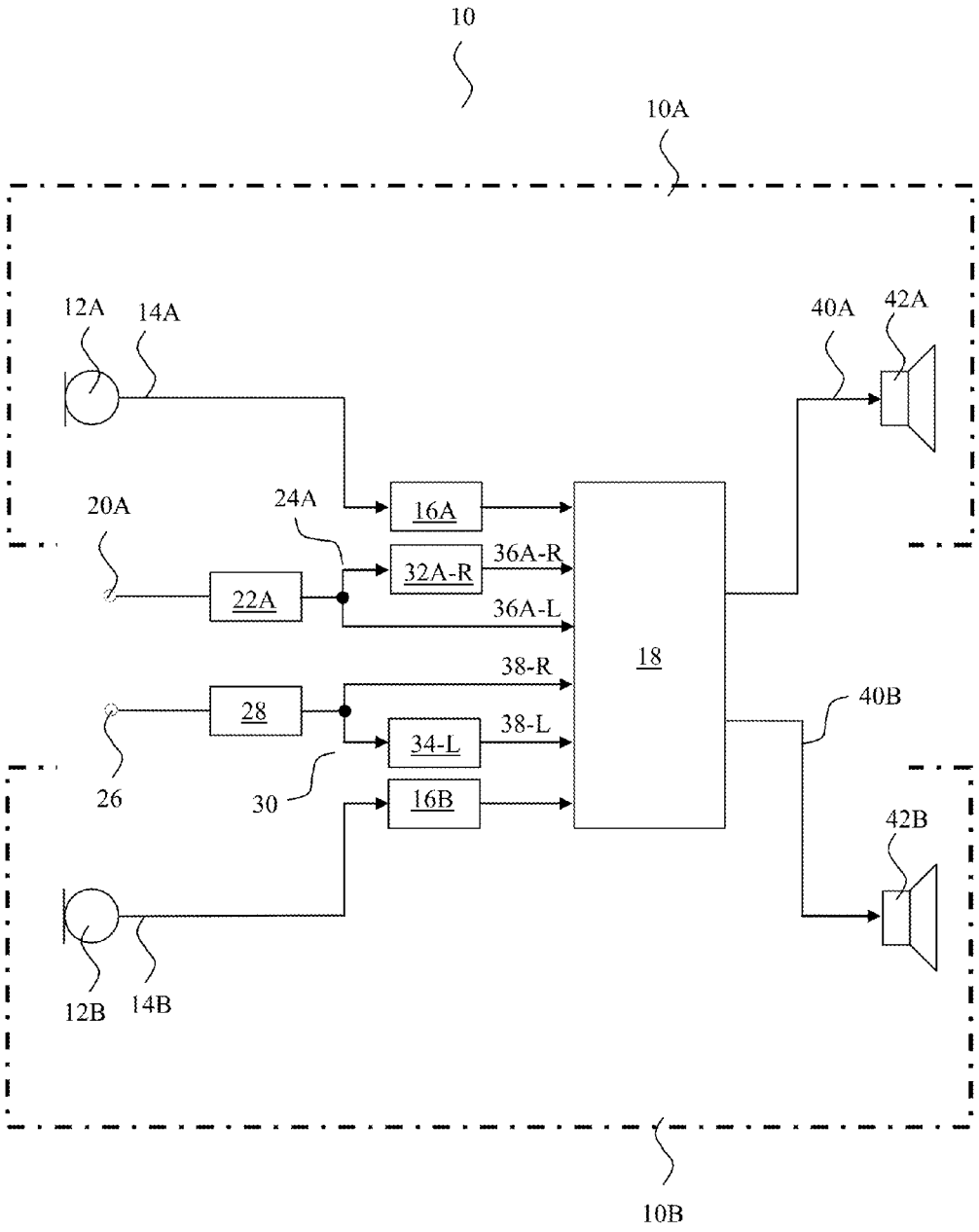

FIG. 3 shows an example of the new binaural hearing aid system 10 similar to the example shown in FIG. 2 except for the fact that improved perceived spatial separation between the first and second sound sources is obtained by introducing an additional delay equal to the ITD of a desired second azimuth direction of arrival in the signal path from the second receiver and decoder 28 to one of the ears of the user. For example, the filter 34-L may introduce a time delay between its input signal 30 and output signal 38-L intended for the left ear of the user, while the filter 34-R shown in FIG. 1 is constituted by a short-circuit between input 30 and output 38-R.

In this way, the perceived azimuth of the direction of arrival of the second sound source is shifted, e.g. to +45° while the perceived azimuth of the direction of arrival of the first sound source remains shifted, e.g. to −45°. Thus, improved perceived spatial separation of the first and second sound sources is obtained, since the first sound source is perceived to be position in a direction determined by the delay 32A-R, e.g. at −45° azimuth, while the second sound source is perceived to be positioned in a direction determined by the delay 34-L, e.g. at +45° azimuth.

In FIGS. 1, 2, and 3, the dashed lines indicate the housings of the first and second hearing aids 10A, 10B accommodating the components of the binaural hearing aid system 10. Each of the housings accommodates the one or more microphones 12A, 12B for reception of sound at the respective ear of the user for which the respective hearing aid 10A, 10B is intended for performing hearing loss compensation, and the respective receiver 42A, 42B for conversion of the respective output signal 40A, 40B of the signal processor 18 into acoustic signals for transmission towards eardrum of the respective one of the right and left ears of the user. The remaining circuitry may be distributed in arbitrary ways between the two hearing aid housings in accordance with design choices made by the designer of the binaural hearing aid system. Each of the signals in the binaural hearing aid system shown in FIGS. 1, 2 and 3 may be transmitted by wired or wireless transmission between the hearing aids 10A, 10B in a way well-known in the art of signal transmission.

Figure 4:
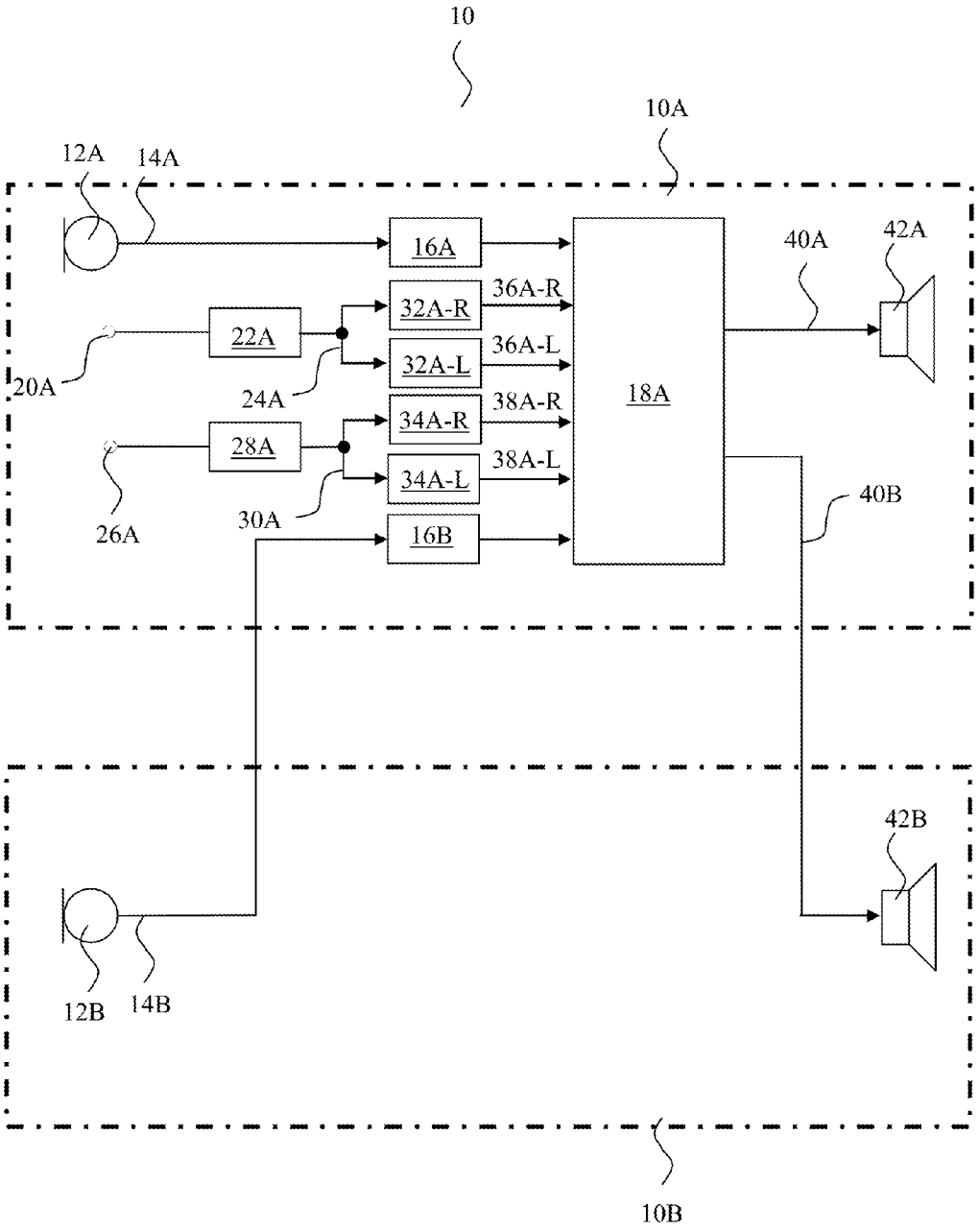

FIG. 4 shows an example of the new binaural hearing aid system 10 shown in FIG. 1, wherein the second hearing aid 10B does not have a signal processor 18 and does not have inputs for provision of first and second audio input signals representing sound from respective first and second sound sources. The second hearing aid 10B only has the one or more second microphone 12B and the second receiver 42B and the required encoder and transmitter (not shown) for transmission of the microphone audio signal 14B for signal processing in the first hearing aid 10A, and receiver and decoder (not shown) for reception of the output signal 40B of the signal processor 18A. The remaining circuitry shown in FIG. 1 is accommodated in the housing of the first hearing aid 10A.

Figure 5:
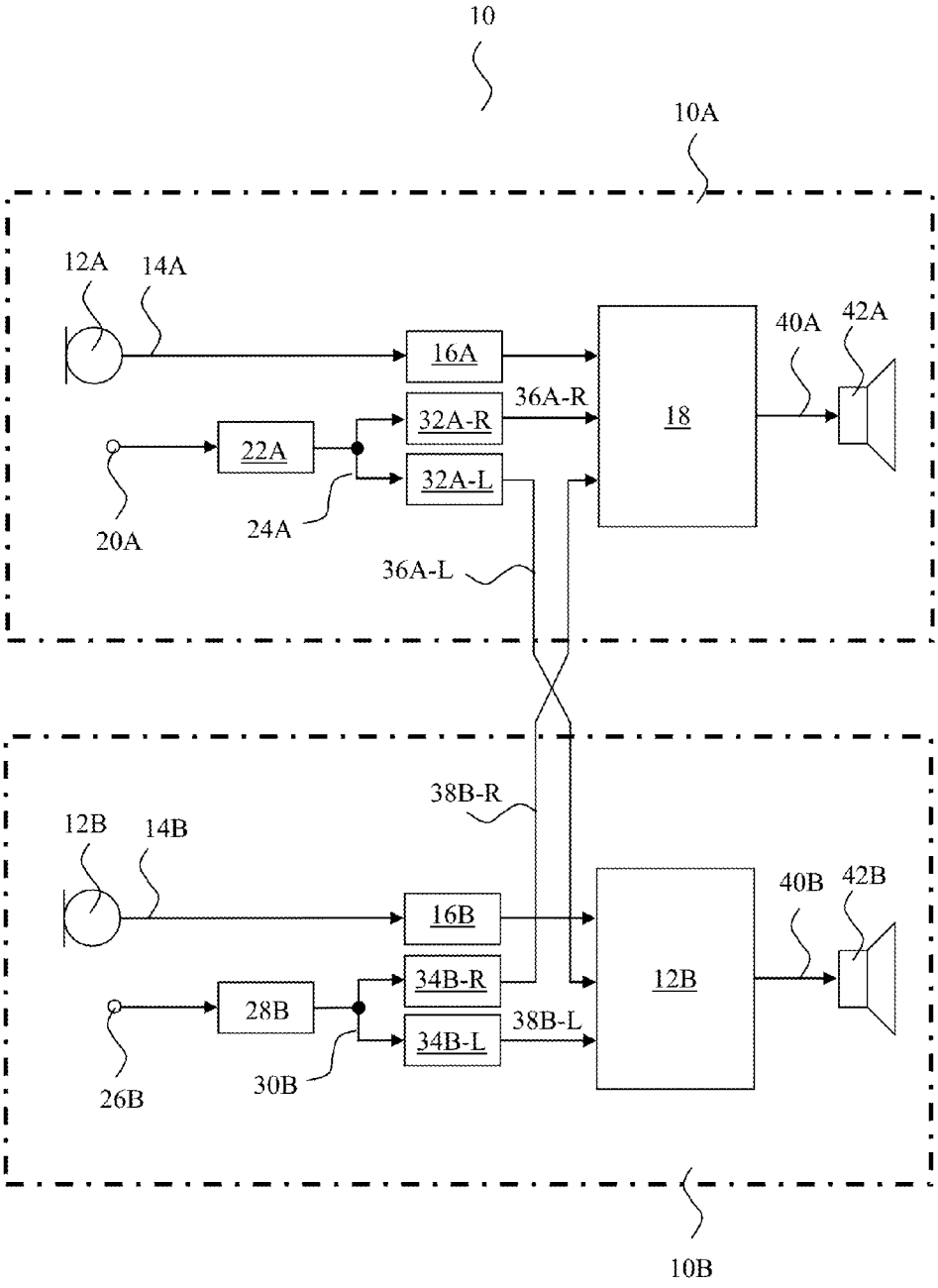

FIG. 5 shows an example of the new binaural hearing aid system 10 shown in FIG. 1, wherein the first and second hearing aids 10A, 10B both comprise a microphone, and a receiver, and a hearing aid processor.

Thus, the illustrated new binaural hearing aid system comprises,

A first hearing aid 10A comprising a first input 20A for provision of a first audio input signal 24A representing sound output by a first sound source and received at the first input 20A, a first binaural filter 32A-R, 32A-L for filtering the first audio input signal 24A and configured to output a first right ear signal 36A-R for the right ear and a first left ear signal 36A-L for the left ear that are that are equal to the first audio input signal multiplied with a first right gain and a different first left gain, respectively, and/or phase shifted with a first phase shift with relation to each other, a first ear receiver 42A for conversion of a first ear receiver input signal 40A into an acoustic signal for transmission towards an eardrum of the first ear of a user of the binaural hearing aid system 10, and a second input 26B for provision of a second audio input signal 30B representing sound output by a second sound source and received at the second input 26B, a second binaural filter 34B-R, 34B-L for filtering the second audio input signal 30B and configured to output a second right ear signal 38B-R for the right ear and a second left ear signal 38B-L for the left ear that are equal to the second audio input signal multiplied with a second right gain and a different second left gain, respectively, and/or that are phase shifted with a second phase shift different from the first phase shift with relation to each other, and wherein the first and second right ear signals 36A-R, 38B-R are provided to the first ear receiver input 40A, and the first and second left ear signals 36A-L, 38B-L are provided to the second ear receiver input 40B, whereby the first sound source will be perceived to be spatially separated from the second sound source.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A binaural hearing aid system comprising:

a first hearing aid; and a second hearing aid;

wherein the first hearing aid comprises a first input for provision of a first audio input signal representing a first speech picked up by a first spouse microphone and transmitted to the first hearing aid;

wherein one of the first and second hearing aids comprises a second input for provision of a second audio input signal representing a second speech picked up by a second spouse microphone and transmitted to the one of the first and second hearing aids;

wherein the first hearing aid comprises a first binaural filter configured to output a first right ear signal for a right ear of a user of the binaural hearing aid system and a first left ear signal for a left ear of the user, wherein the first binaural filter is configured to determine the first right ear signal at least by applying a first right gain to the first audio input signal, and wherein the first binaural filter is also configured to determine the first left ear signal at least by applying a first left gain to the first audio input signal, the first left gain being different from the first right gain;

wherein the first hearing aid comprises a first ear receiver;

wherein the second hearing aid comprises a second ear receiver;

wherein one of the first ear receiver and the second ear receiver is configured to provide an acoustic signal for transmission towards an eardrum of the first ear of a user of the binaural hearing aid system based on the first right ear signal, and the other one of the first ear receiver and the second receiver is configured to provide an acoustic signal for transmission towards an eardrum of the second ear of the user of the binaural hearing aid system based on the first left ear signal; and wherein the first audio input signal is a monaural audio signal, and wherein the first binaural filter is configured to determine the first right ear signal and the first left ear signal so that artificial directionality is provided for the monaural audio signal, and wherein the artificial directionality is defined by the binaural hearing aid system.

2. The binaural hearing aid system according to claim 1, wherein the first ear receiver and the second ear receiver are configured to provide the acoustic signals so that a first sound source of the first speech and a second sound source of the second speech will be perceived by the user as being spatially separated from each other.

3. The binaural hearing aid system according to claim 1, wherein one of the first right ear signal and the first left ear signal is phase shifted with relation to the first audio input signal, and the other one of the first right ear signal and the first left ear signal is the first audio input signal.

4. The binaural hearing aid system of claim 1, wherein the first binaural filter is also configured to apply a first phase shift so that the first right ear signal and the first left ear signal are phase shifted by the first phase shift with respect to each other.

5. The binaural hearing aid system according to claim 4, wherein the first phase shift has a value that is anywhere from 150° to 210°.

6. The binaural hearing aid system according to claim 4, wherein the first phase shift corresponds to an azimuth directional change that is anywhere from −90° to 90°.

7. The binaural hearing aid system according to claim 1, wherein:

the second input is a part of a second hearing aid.

8. A binaural hearing aid system comprising:

a first hearing aid; and a second hearing aid;

wherein the first hearing aid comprises a first input for provision of a first audio input signal representing a first speech picked up by a first spouse microphone and transmitted to the first hearing aid;

wherein one of the first and second hearing aids comprises a second input for provision of a second audio input signal representing a second speech picked up by a second spouse microphone and transmitted to the one of the first and second hearing aids;

wherein the first hearing aid comprises a first binaural filter configured to output a first right ear signal for a right ear of a user of the binaural hearing aid system and a first left ear signal for a left ear of the user, wherein the first binaural filter is configured to determine the first right ear signal at least by applying a first right gain to the first audio input signal, and wherein the first binaural filter is also configured to determine the first left ear signal at least by applying a first left gain to the first audio input signal, the first left gain being different from the first right gain;

wherein the first hearing aid comprises a first ear receiver;

wherein the second hearing aid comprises a second ear receiver;

wherein one of the first ear receiver and the second ear receiver is configured to provide an acoustic signal for transmission towards an eardrum of the first ear of a user of the binaural hearing aid system based on the first right ear signal, and the other one of the first ear receiver and the second receiver is configured to provide an acoustic signal for transmission towards an eardrum of the second ear of the user of the binaural hearing aid system based on the first left ear signal;

wherein the binaural hearing aid system further comprises a second binaural filter configured to output a second right ear signal for the right ear and a second left ear signal for the left ear, wherein the second binaural filter is configured to determine the second right ear signal at least by applying a second right gain to the second audio input signal, and wherein the second binaural filter is also configured to determine the second left ear signal at least by applying a second left gain to the second audio input signal, the second left gain being different from the second right gain;

wherein one of the first ear receiver and the second ear receiver is configured to receive the second right ear signal, and the other one of the first ear receiver and the second ear receiver is configured to receive the second left ear signal; and wherein the first audio input signal is a monaural audio signal, and wherein the first binaural filter is configured to determine the first right ear signal and the first left ear signal so that an artificial directionality is provided for the monaural audio signal, and wherein the artificial directionality is defined by the binaural hearing aid system.

9. The binaural hearing aid system according to claim 8, wherein:

the first hearing aid comprising the second input, and the second binaural filter, the first ear receiver.

10. The binaural hearing aid system according to claim 8, wherein:

the second hearing aid comprising the second input, and the second binaural filter.

11. The binaural hearing aid system according to claim 1, wherein the first binaural filter is a HRTF filter.

12. The binaural hearing aid system according to claim 8, wherein the second binaural filter is a HRTF filter.

13. The binaural hearing aid system of claim 8, wherein the first binaural filter is also configured to apply a first phase shift so that the first right ear signal and the first left ear signal are phase shifted by the first phase shift with respect to each other.

14. The binaural hearing aid system of claim 13, wherein second binaural filter is also configured to apply a second phase shift so that the second right ear signal and the second left ear signal are phase shifted by the second phase shift with respect to each other.

15. The binaural hearing aid system of claim 14, wherein the second phase shift is different from the first phase shift.

16. The binaural hearing aid system according to claim 8, wherein:

the second input is a part of a second hearing aid.

17. The binaural hearing aid system of claim 8, wherein the second audio input signal is another monaural audio signal, and wherein the second binaural filter is configured to provide an artificial directionality for the other monaural audio signal, the artificial directionality for the monaural audio signal being different from the artificial directionality for the other monaural audio signal.

18. A method of binaural signal enhancement in a binaural hearing aid system, comprising:

binaurally processing a first audio input signal representing a first speech picked up by a first spouse microphone into a first right ear signal for a right ear of a user of the binaural hearing aid system and a first left ear signal for a left ear of the user, wherein the act of binaurally processing the first audio input signal comprises applying a first right gain to the first audio input signal, and applying a first left gain to the first audio input signal, the first left gain being different from the first right gain;

providing the first right ear signal and the first left ear signal to the right and left ears, respectively, of the user, and providing a second audio input signal representing a second speech picked up by a second spouse microphone to both the right and left ears of the user;

wherein the first audio input signal is a monaural audio signal, and wherein the binaural processing is performed to provide an artificial directionality for the monaural audio signal, and wherein the artificial directionality is defined by the binaural hearing aid system.

19. The method according to claim 18, wherein the acts of providing are performed so that a first sound source of the first speech and a second sound source of the second speech will be perceived by the user as being spatially separated from each other.

20. The method according to claim 18, further comprising:

binaurally processing the second audio input signal into a second right ear signal for the right ear and a second left ear signal for the left ear, wherein the act of binaurally processing the second audio input signal comprises applying a second right gain to the second audio input signal, and applying a second left gain to the second audio input signal, the second left gain being different from the second right gain;

wherein the act of providing the second audio input signal to both the right and left ears comprises providing the second right ear signal and the second left ear signal to the right and left ears, respectively, of the user.

21. The method of claim 18, wherein the act of binaurally processing the first audio input signal further comprises applying a first phase shift so that the first right ear signal and the first left ear signal are phase shifted by a first phase shift with respect to each other.

22. A binaural hearing aid system comprising:

a first hearing aid; and a second hearing aid;

wherein the first hearing aid comprises a first input for provision of a first audio input signal representing a first speech picked up by a first spouse microphone and transmitted to the first hearing aid;

wherein one of the first and second hearing aids comprises a second input for provision of a second audio input signal representing a second speech picked up by a second spouse microphone and transmitted to the one of the first and second hearing aids;

wherein the first hearing aid comprises a first binaural filter configured to output a first right ear signal for a right ear of a user of the binaural hearing aid system and a first left ear signal for a left ear of the user, wherein the first binaural filter is configured to determine a first phase shift, and to apply the first phase shift so that the first right ear signal and the first left ear signal are phase shifted by the first phase shift with respect to each other in relation to a head of the user;

wherein the first hearing aid comprises a first ear receiver;

wherein the second hearing aid comprises a second ear receiver;

wherein one of the first ear receiver and the second ear receiver is configured to provide an acoustic signal for transmission towards an eardrum of the first ear of a user of the binaural hearing aid system based on the first right ear signal, and the other one of the first ear receiver and the second receiver is configured to provide an acoustic signal for transmission towards an eardrum of the second ear of the user of the binaural hearing aid system based on the first left ear signal; and wherein the first audio input signal is a monaural audio signal, and wherein the first binaural filter is configured to provide an artificial directionality for the monaural audio signal, and wherein the artificial directionality is defined by the binaural hearing aid system.

23. The binaural hearing aid system of claim 22, further comprising a second binaural filter configured to provide artificial directionality for another monaural audio signal, wherein the directionality for the monaural audio signal is different from the directionality for the other monaural audio signal.

24. A method performed by a hearing aid system, comprising:

processing a first audio input signal representing a first speech picked up by a first spouse microphone into a first right ear signal for a right ear of a user of the hearing aid system and a first left ear signal for a left ear of the user, the first audio input signal transmitted for reception by the hearing aid system; and providing the first right ear signal and the first left ear signal to the right and left ears, respectively, of the user;

wherein the first audio input signal is a monaural audio signal, and wherein the processing is performed to provide a directionality for the monaural audio signal.

25. The method of claim 24, wherein the directionality is defined by the hearing aid system.

26. The method of claim 24, further comprising:

processing a second audio input signal representing a second speech picked up by a second spouse microphone into a second right ear signal for the right ear of the user of the hearing aid system and a second left ear signal for the left ear of the user, the second audio input signal transmitted for reception by the hearing aid system; and providing the second right ear signal and the second left ear signal to the right and left ears, respectively, of the user.

27. The method of claim 26, wherein the acts of processing and the acts of providing are performed so that a first sound source of the first speech and a second sound source of the second speech will be perceived by the user as being spatially separated from each other.

28. A hearing aid system comprising:

a processing unit configured to process a first audio input signal representing a first speech picked up by a first spouse microphone into a first right ear signal for a right ear of a user of the hearing aid system and a first left ear signal for a left ear of the user, the first audio input signal transmitted for reception by the hearing aid system;

a first receiver configured to provide the first right ear signal to the right ear of the user; and a second receiver configured to provide the first left ear signal to the left ear of the user;

wherein the first audio input signal is a monaural audio signal, and wherein the processing unit is configured to process the first audio signal to provide a directionality for the monaural audio signal.

29. The hearing aid system of claim 28, wherein the hearing aid system is configured to define the directionality.

30. The hearing aid system of claim 28, wherein the processing unit is also configured to process a second audio input signal representing a second speech picked up by a second spouse microphone into a second right ear signal for the right ear of the user, and a second left ear signal for the left ear of the user, the second audio input signal transmitted for reception by the hearing aid system;

wherein the first receiver is configured to provide the second right ear signal to the right ear of the user; and wherein the second receiver is configured to provide the second left ear signal to the left ear of the user.

31. The hearing aid system of claim 30, wherein the first right ear signal, the first left ear signal, the second right ear signal, and the second left ear signal allow a first sound source of the first speech and a second sound source of the second speech to be perceived by the user as being spatially separated from each other.

32. The hearing aid system of claim 30, further comprising a first filter for processing the first audio input signal, and a second filter for processing the second audio input signal.

33. A method performed by a hearing aid system, comprising:

processing a first audio input signal representing a first speech picked up by a first spouse microphone into a first right ear signal for a right ear of a user of the hearing aid system and a first left ear signal for a left ear of the user, the first audio input signal transmitted for reception by the hearing aid system; and providing the first right ear signal and the first left ear signal to the right and left ears, respectively, of the user;

wherein the first audio input signal is a monaural audio signal, and wherein the processing is performed to provide a directionality for the monaural audio signal; and wherein the directionality is defined by the hearing aid system.

34. The method of claim 33, further comprising:

processing a second audio input signal representing a second speech picked up by a second spouse microphone into a second right ear signal for the right ear of the user of the hearing aid system and a second left ear signal for the left ear of the user, the second audio input signal transmitted for reception by the hearing aid system; and providing the second right ear signal and the second left ear signal to the right and left ears, respectively, of the user.

35. The method of claim 34, wherein the acts of processing and the acts of providing are performed so that a first sound source of the first speech and a second sound source of the second speech will be perceived by the user as being spatially separated from each other.

36. A hearing aid system comprising:

a processing unit configured to process a first audio input signal representing a first speech picked up by a first spouse microphone into a first right ear signal for a right ear of a user of the hearing aid system and a first left ear signal for a left ear of the user, the first audio input signal transmitted for reception by the hearing aid system;

a first receiver configured to provide the first right ear signal to the right ear of the user; and a second receiver configured to provide the first left ear signal to the left ear of the user;

wherein the first audio input signal is a monaural audio signal, and wherein the processing unit is configured to process the first audio signal to provide a directionality for the monaural audio signal; and wherein the hearing aid system is configured to define the directionality.

37. The hearing aid system of claim 36, wherein the processing unit is also configured to process a second audio input signal representing a second speech picked up by a second spouse microphone into a second right ear signal for the right ear of the user, and a second left ear signal for the left ear of the user, the second audio input signal transmitted for reception by the hearing aid system;

wherein the first receiver is configured to provide the second right ear signal to the right ear of the user; and wherein the second receiver is configured to provide the second left ear signal to the left ear of the user.

38. The hearing aid system of claim 37, wherein the first right ear signal, the first left ear signal, the second right ear signal, and the second left ear signal allow a first sound source of the first speech and a second sound source of the second speech to be perceived by the user as being spatially separated from each other.

39. The hearing aid system of claim 37, further comprising a first filter for processing the first audio input signal, and a second filter for processing the second audio input signal.

* * * * *